US009729955B2

(12) United States Patent
Tan

(10) Patent No.: US 9,729,955 B2
(45) Date of Patent: Aug. 8, 2017

(54) HEADSET CONTROL METHOD AND HEADSET

(75) Inventor: Qingsong Tan, Hunan (CN)

(73) Assignee: SHENZHEN LEZUN ELECTRONICS LIMITED, Shenzhen, Guangdong (CN)

( * ) Notice: Subject to any disclaimer, the term of this patent is extended or adjusted under 35 U.S.C. 154(b) by 0 days.

(21) Appl. No.: 13/807,794

(22) PCT Filed: Jan. 12, 2012

(86) PCT No.: PCT/CN2012/070295

§ 371 (c)(1),
(2), (4) Date: Dec. 31, 2012

(87) PCT Pub. No.: WO2013/097306

PCT Pub. Date: Jul. 4, 2013

(65) Prior Publication Data

US 2014/0301559 A1 Oct. 9, 2014

(30) Foreign Application Priority Data

Dec. 28, 2011 (CN) ..... 2011 1 0446825

(51) Int. Cl.
*H04R 1/10* (2006.01)

(52) U.S. Cl.
CPC ..... *H04R 1/1041* (2013.01)

(58) Field of Classification Search
CPC ..... H04R 5/033; H04R 1/1041
USPC ..... 381/74
See application file for complete search history.

(56) References Cited

U.S. PATENT DOCUMENTS

2009/0313303 A1* 12/2009 Spence ..... G06F 17/30053
2010/0172522 A1* 7/2010 Mooring et al. ..... 381/311
2010/0202626 A1* 8/2010 Shiori ..... G06F 3/017 381/74
2011/0285554 A1* 11/2011 Aghaei et al. ..... 341/33
2011/0293102 A1* 12/2011 Kitazawa ..... H04R 1/1041 381/56
2012/0082321 A1* 4/2012 Akaike ..... H04R 1/1041 381/74
2012/0196540 A1* 8/2012 Pearce ..... 455/41.3
2012/0217145 A1* 8/2012 Yi ..... G06F 3/044 200/5 A

* cited by examiner

*Primary Examiner* — Sonia Gay
(74) *Attorney, Agent, or Firm* — Jackson IPG PLLC; Demian K. Jackson

(57) ABSTRACT

The invention provides a headset control method, comprising the following steps: A) a capacitive sensing circuit electrode layer detects sliding coordinate signals and trajectory signals; B) a processing unit receives the coordinate signals and trajectory signals detected by the capacitive sensing circuit electrode layer; C) the processing unit analyzes whether the received coordinate signals and the trajectory signals meet control rules that are already defined and converts the coordinate signals and trajectory signals meeting the control rules into instructions to be transmitted to a main control chip; D) the main control chip is connected with a playback equipment terminal and the main control chip transmits the instructions to the playback equipment terminal, and the playback equipment terminal executes the instructions.

4 Claims, 2 Drawing Sheets

HEADSET CONTROL METHOD AND HEADSET

TECHNICAL FIELD OF THE INVENTION

The present invention relates to a control method, in particular to a headset control method and a headset.

BACKGROUND OF THE INVENTION

For existing headsets, there are two major ways for equipment volume control and song control. The first way is to control via a drive-by-wire device on the headset wire, with a plurality of keys arranged on the drive-by wire device. The second way is to control via a plurality of keys on the housing of the headset muff.

The first way is to control via a drive-by-wire device on the headset wire, with a plurality of keys arranged on the drive-by-wire device. This control way is quite intuitive and easy to operate. It is a good equipment control way and also the most common control way at present. The defect is that it is impossible to use this control way in the case of a wireless headset.

The second way is to control via a plurality of keys on the housing of the headset muff. It is also a control way for most wireless headsets and can substantially meet the requirements of the users on equipment control. The defect is that, as the headset is worn on the head, the keys cannot be seen by eyes, the equipment can only be operated and controlled via finger touches, thus easily leading to wrong key presses, and both accuracy and user experience are not satisfactory.

SUMMARY OF THE INVENTION

To solve the problems in the prior art, the invention provides a headset control method.

The invention provides a headset control method, comprising the following steps:

A. a capacitive sensing circuit electrode layer detects sliding coordinate signals and trajectory signals;

B. a processing unit receives the coordinate signals and trajectory signals detected by the capacitive sensing circuit electrode layer;

C. the processing unit analyzes whether the received coordinate signals and trajectory signals meet the control rules that are already defined, converts the coordinate signals and trajectory signals meeting the control rules into instructions to be transmitted to a main control chip;

D. the main control chip is connected with a playback equipment terminal and transmits the instructions to the playback equipment terminal which executes the instructions.

As a further improvement of the invention, in said Step C, the processing unit comprises a capacitive touch chip which analyzes whether the received coordinate signals and trajectory signals meet control rules that are already defined and converts the coordinate signals and trajectory signals meeting the control rules into instructions to be transmitted to a main control chip.

As a further improvement of the invention, in said Step C, the processing unit comprises a capacitive touch chip and a microprocessor connected with the capacitive touch chip, the capacitive touch chip analyzes whether the received coordinate signals and trajectory signals meet control rules that are already defined, and the microprocessor converts the coordinate signals and trajectory signals meeting the control rules into instructions to be transmitted to a main control chip.

As a further improvement of the invention, in said Step C, the coordinate signals and the trajectory signals are compared with the control rules, and the coordinate signals and the trajectory signals are converted into instructions to be transmitted to a main control chip if the coordinate signals and the trajectory signals match the control rules.

As a further improvement of the invention, the matched control rules are determined according to a trend of continuous increment or continuous decrement of the coordinate signals and the trajectory signals towards a single direction.

As a further improvement of the invention, the matched control rules are determined according to a trend of continuous increment of the coordinate signals and the trajectory signals towards two directions from one point or a trend of continuous decrement towards one point from two directions.

The invention also provides a headset, comprising a headset housing, a capacitive sensing circuit electrode layer, a processing unit, a main control chip and a playback equipment terminal, the capacitive sensing circuit electrode layer is arranged on the inner surface of the headset housing, and the capacitive sensing circuit electrode layer is configured to detect sliding coordinate signals and trajectory signals; the processing unit is configured to receive the coordinate signals and trajectory signals detected by the capacitive sensing circuit electrode layer; the processing unit is connected with the main control chip, and the main control chip receives instructions transmitted by the processing unit; the main control chip is also connected with the playback equipment terminal and the main control chip transmits the instructions to the playback equipment terminal, and the playback equipment terminal executes the instructions.

As a further improvement of the invention, the processing unit comprises a capacitive touch chip, the capacitive touch chip is connected with the capacitive sensing circuit electrode layer, the capacitive touch chip is arranged on the flat cable of the capacitive sensing circuit electrode layer, the capacitive touch chip is configured to analyze whether the received coordinate signals and trajectory signals meet control rules that are already defined, and convert the coordinate signals and trajectory signals meeting the control rules into instructions to be transmitted to a main control chip; and the capacitive sensing circuit electrode layer and the flat cable of the capacitive sensing circuit electrode layer form an integrated flexible circuit board.

As a further improvement of the invention, the headset also comprises a circuit board, the processing unit comprises a capacitive touch chip and a microprocessor connected with the capacitive touch chip, the microprocessor is arranged on the circuit board, and the capacitive sensing circuit electrode layer is connected with the circuit board via the flat cable; the capacitive touch chip is configured to analyze whether the received coordinate signals and trajectory signals meet control rules that are already defined, the microprocessor is configured to convert the coordinate signals and trajectory signals meeting the control rules into instructions to be transmitted to a main control chip; the capacitive touch chip is connected with the capacitive sensing circuit electrode layer, and the capacitive touch chip is arranged on the flat cable of the capacitive sensing circuit electrode layer; and the capacitive sensing circuit electrode layer and the flat cable of the capacitive sensing circuit electrode layer form an integrated flexible circuit board.

As a further improvement of the invention, the processing unit, the main control chip, the playback equipment terminal and the circuit board are all located inside the headset housing.

The invention has the following advantages. The headset control method and the headset of the invention greatly improve the ease and convenience in users' headset use and fundamentally change the way users operate the headsets. The mode of the invention is novel, cool, fast, accurate and effective. Excellent user experience is brought to the users. In the case of headset control, users only need to remember several simple control gestures to conveniently control the headsets via the capacitive sensing circuit electrode layer. The truly user-friendly headset use is realized and users are provided with super technical experience.

DETAILED DESCRIPTION OF THE INVENTION

Figure 1:
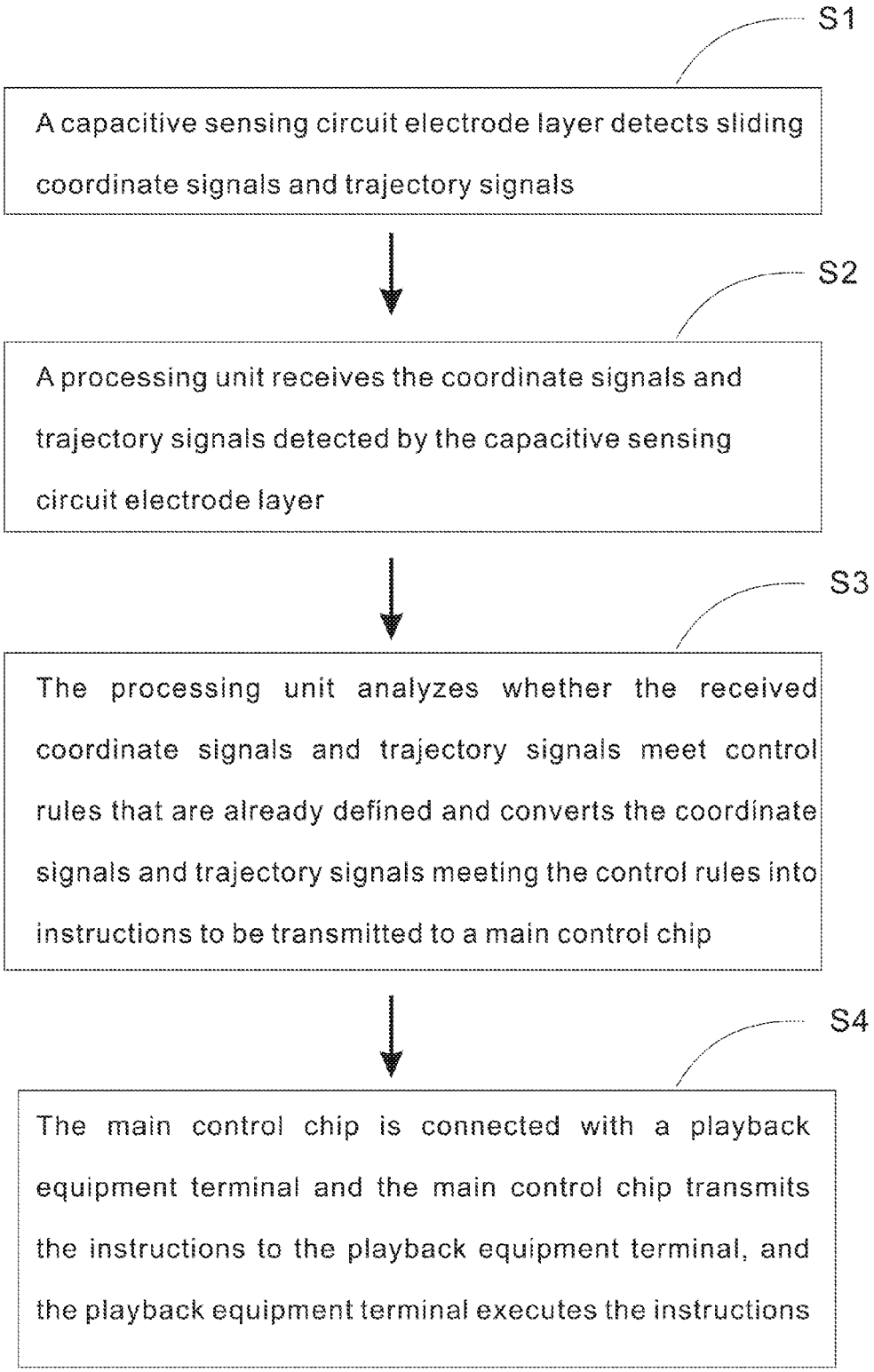
FIG. 1 is a flowchart of a method of the invention.

As shown in FIG. 1, the invention discloses a headset control method, comprising the following four steps: in S1, a capacitive sensing circuit electrode layer detects sliding coordinate signals and trajectory signals; in S2, a processing unit receives the coordinate signals and trajectory signals detected by the capacitive sensing circuit electrode layer; in S3, the processing unit analyzes whether the received coordinate signals and trajectory signals meet control rules that are already defined and converts the coordinate signals and trajectory signals meeting the control rules into instructions to be transmitted to a main control chip; and in S4, the main control chip is connected with a playback equipment terminal and the main control chip transmits the instructions to the playback equipment terminal, and the playback equipment terminal executes the instructions.

As one embodiment of the headset control method, in S3, the processing unit comprises a capacitive touch chip, and the capacitive touch chip analyzes whether the received coordinate signals and trajectory signals meet control rules that are already defined, and converts the coordinate signals and trajectory signals meeting the control rules into instructions to be transmitted to a main control chip.

As another embodiment of the headset control method, in S3, the processing unit comprises a capacitive touch chip and a microprocessor connected with the capacitive touch chip, the capacitive touch chip analyzes whether the received coordinate signals and trajectory signals meet control rules that are already defined, and the microprocessor converts the coordinate signals and trajectory signals meeting the control rules into instructions to be transmitted to a main control chip.

In S3, the coordinate signals and the trajectory signals are compared with the control rules, and the coordinate signals and the trajectory signals are converted into instructions to be transmitted to a main control chip if the coordinate signals and the trajectory signals match the control rules. The instructions include volume adjustment instructions, song play order instructions and song FF/REW instructions.

As one embodiment of the invention, matching of the coordinate signals and trajectory signals with the control rules means that the matched control rules are determined according to a trend of continuous increment or continuous decrement of the coordinate signals and the trajectory signals towards a single direction. For example, the processing unit will divide the periphery of the capacitive sensing circuit electrode layer into four directions (left, right, up and down), N (here, N represents multiple, the number of information points depends on the area of the capacitive sending circuit electrode layer) information points will be distributed on the surface of the capacitive sending circuit electrode layer evenly. When a finger touches the surface of the headset housing on the capacitive sending circuit electrode layer, the corresponding information points on the capacitive sending circuit electrode layer will detect the action of the finger and send the signals to the processing unit. The processing unit gathers information about each of the touched coordinates together, and determines which control rule a gesture corresponds to, according to a trend of increment or decrement of these coordinate information data and trajectories towards which direction. For example, the processing unit will judge an increment over seven (this figure is customized) continuous information points from left to right as one control rule, the instructions meeting this control rule then correspond to a NEXT instruction for song control of the playback equipment terminal via a link between the main control chip and the playback equipment terminal. Similarly, an increment over seven (this figure is customized) continuous information points from right to left may also be judged as another control rule. Also, an increment over three (this figure is customized) continuous information points may be judged as one control rule. This rule may also correspond to volume-up and volume-down instructions of the playback equipment terminal, and a decrement over three (this figure is customized) continuous information points is judged as another control rule, or the like.

As another embodiment of the invention, matching of the coordinate signals and the trajectory signals and the control rules means that the matched control rules are determined according to a trend of continuous increment of the coordinate signals and the trajectory signals towards two directions from one point or a trend of continuous decrement towards one point from two directions; for example, via an action of zoom-in or zoom-out by two fingers.

Of course, users may also move a finger in circle on the capacitive sensing circuit electrode layer, to turn up the volume clockwise and turn down the volume counterclockwise.

Figure 2:
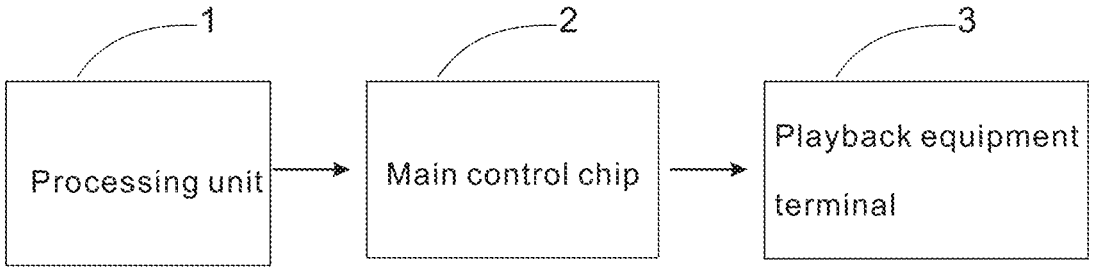
FIG. 2 is a functional block diagram of the invention.

As shown in FIG. 2, the invention also discloses a headset, comprising a headset housing, a capacitive sensing circuit electrode layer, a processing unit 1, a main control chip 2 and a playback equipment terminal 3, the capacitive sensing circuit electrode layer is arranged on the inner surface of the headset housing, and the capacitive sensing circuit electrode layer is configured to detect sliding coordinate signals and trajectory signals; the processing unit 1 is configured to receive the coordinate signals and trajectory signals detected by the capacitive sensing circuit electrode layer; the processing unit 1 is connected with the main control chip 2, and the main control chip 2 receives instructions transmitted by the processing unit 1; the main control chip 2 is also connected with the playback equipment terminal 3 and the main control chip 2 transmits the instructions to the playback equipment terminal 3, and the playback equipment terminal 3 executes the instructions.

As one embodiment of the headset, the processing unit 1 comprises a capacitive touch chip, the capacitive touch chip is connected with the capacitive sensing circuit electrode layer, the capacitive touch chip is arranged on the flat cable of the capacitive sensing circuit electrode layer, the capacitive touch chip is configured to analyze whether the received coordinate signals and trajectory signals meet control rules that are already defined, and convert the coordinate signals and trajectory signals meeting the control rules into instructions to be transmitted to a main control chip 2; and the capacitive sensing circuit electrode layer and the flat cable of the capacitive sensing circuit electrode layer form an integrated flexible circuit board.

As another embodiment of the headset, the headset also comprises a circuit board, the processing unit 1 comprises a capacitive touch chip and a microprocessor connected with the capacitive touch chip, the microprocessor is arranged on the circuit board, and the capacitive sensing circuit electrode layer is connected with the circuit board via the flat cable; the capacitive touch chip is configured to analyze whether the received coordinate signals and trajectory signals meet control rules that are already defined, the microprocessor is configured to convert the coordinate signals and trajectory signals meeting the control rules into instructions to be transmitted to a main control chip 2; the capacitive touch chip is connected with the capacitive sensing circuit electrode layer, and the capacitive touch chip is arranged on the flat cable of the capacitive sensing circuit electrode layer; and the capacitive sensing circuit electrode layer and the flat cable of the capacitive sensing circuit electrode layer form an integrated flexible circuit board.

In the invention, as the headset housing is curved, the flexible circuit board is employed; of course, the headset housing may also be flat, the flexible circuit board may not be employed, a common dual-surface or multi-surface Printing Circuit Board (PCB) is employed, the capacitive sensing circuit electrode layer is arranged on the top layer of the PCB, and the capacitive touch chip and the microprocessor as well as the main control chip 2 may be all arranged on the bottom layer of the PCB.

The processing unit 1, the main control chip 2, the playback equipment terminal 3 and the circuit board are all located inside the headset housing. The main control chip 2 and the playback equipment terminal 3 are connected by wires or wirelessly.

In addition to necessary main function keys, there is no any key for equipment volume control and song control on the outer surface of the headset housing of the invention. All operations involving equipment volume and song control are controlled by the capacitive sensing circuit electrode layer.

For the volume control of the headset, it is possible to move a single finger upwards and downwards on the capacitive sensing circuit electrode layer to control the volume; it is also possible to move a finger in circle on the capacitive sensing circuit electrode layer clockwise and counterclockwise to control the volume; it is still possible to make two fingers or multiple fingers pinch in or out on the capacitive sensing circuit electrode layer to control the volume of the headset, or the like.

For the song control of the headset, it is possible to move a single finger or multiple fingers on the capacitive sensing circuit electrode layer forwards/backwards or leftwards/rightwards to control Forward/Backward and Last and Next, or the like.

The headset control method and the headset of the invention greatly improve the ease and convenience in users' headset use and fundamentally change the way users operate the headsets. The mode of the invention is novel, cool, fast, accurate and effective. Excellent user experience is brought to the users. In the case of headset control, users only need to remember several simple control gestures to conveniently control the headsets via the capacitive sensing circuit electrode layer. The truly user-friendly headset use is realized and users are provided with super technical experience.

Above description is a further detailed explanation of the invention in combination with preferred embodiments, but the embodiments of the invention should not be regarded to be limited to these descriptions. For those skilled in the technical field to which the invention belongs, within the concept of the invention, the invention may have various simple derivatives and alternatives which should all be regarded to fall within the protection scope of the invention.

What is claimed is:

1. A headset, comprising a headset housing, a capacitive sensing circuit electrode layer arranged on an inner surface of the headset housing, a flat cable wherein the capacitive sensing circuit electrode layer and the flat cable form an integrated flexible circuit board, a capacitive touch chip connected to the capacitive sensing circuit electrode layer and arranged on the flat cable of the capacitive sensing circuit electrode layer, a processing unit, a main control chip and a playback equipment terminal, wherein the capacitive sensing circuit electrode layer is configured to detect sliding coordinate signals and trajectory signals; the processing unit is configured to receive the coordinate signals and trajectory signals detected by the capacitive sensing circuit electrode layer; the processing unit is connected with the main control chip, and the main control chip receives instructions, including volume adjustment, song play order, song skip, and fast forward/reverse instructions, transmitted by the processing unit; the main control chip is also connected with the playback equipment terminal and the main control chip transmits the instructions to the playback equipment terminal, and the playback equipment terminal executes the instructions.

2. The headset according to claim 1, wherein the headset also comprises a circuit board, the processing unit comprises a microprocessor connected with the capacitive touch chip and arranged on the circuit board; the capacitive touch chip is configured to analyze whether the received coordinate signals and the trajectory signals meet control rules that are already defined, the microprocessor is configured to convert the coordinate signals and trajectory signals meeting the control rules into instructions to be transmitted to the main control chip.

3. The headset according to claim 1, wherein the processing unit, the main control chip, the playback equipment terminal and a circuit board are all located inside the headset housing.

4. The headset according to claim 2, wherein the processing unit, the main control chip, the playback equipment terminal and the circuit board are all located inside the headset housing.

* * * * *